US012714911B2

(12) United States Patent
James et al.

(10) Patent No.: US 12,714,911 B2
(45) Date of Patent: Aug. 25, 2026

(54) CONDITION DETECTION

(71) Applicant: Tonal Systems, Inc., San Francisco, CA (US)

(72) Inventors: Bryan James, Menlo Park, CA (US); Brandt Belson, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 103 days.

(21) Appl. No.: 17/876,179

(22) Filed: Jul. 28, 2022

(65) Prior Publication Data

US 2024/0033571 A1 Feb. 1, 2024

(51) Int. Cl.

*A63B 24/00* (2006.01)
*A63B 21/005* (2006.01)
*A63B 71/00* (2006.01)

(52) U.S. Cl.

CPC ..... *A63B 24/0062* (2013.01); *A63B 21/0058* (2013.01); *A63B 71/0054* (2013.01); *A63B 2024/0071* (2013.01)

(58) Field of Classification Search

CPC ..... A63B 24/0062; A63B 2024/0071; A63B 21/0058; A63B 71/0054; A63B 21/008; A63B 21/012; A63B 21/02; A63B 21/156; A63B 21/4043; A63B 2071/0072; A63B 2071/0081; A63B 2071/0677; A63B 2071/068; A63B 2220/40; A63B 24/0087; A63B 2220/30; A63B 2220/51; A63B 2220/58; A63B 2220/64; A63B 2220/806; A63B 2220/808; A63B 2225/20; A63B 2225/50; A63B 2230/06; A63B 2230/207

See application file for complete search history.

(56) References Cited

U.S. PATENT DOCUMENTS

| | | | | |
|---|---|---|---|---|
| 10,252,145 | B2 * | 4/2019 | Tran | G06V 40/28 |
| 2020/0196105 | A1 * | 6/2020 | Hunter | G08B 21/0261 |
| 2020/0376321 | A1 * | 12/2020 | Davis | A63B 21/154 |
| 2021/0077884 | A1 * | 3/2021 | De las Casas Zolezzi | A63B 24/0087 |
| 2021/0387038 | A1 * | 12/2021 | Premachandra | A63B 21/4029 |
| 2022/0262483 | A1 * | 8/2022 | Rosenberg | G16H 20/30 |
| 2022/0296960 | A1 * | 9/2022 | Fung | A63F 13/212 |
| 2023/0128118 | A1 * | 4/2023 | Kadav | A63B 21/153 482/8 |

* cited by examiner

*Primary Examiner* — Megan Anderson
*Assistant Examiner* — Catrina A Letterman
(74) *Attorney, Agent, or Firm* — Van Pelt, Yi & James LLP

(57) ABSTRACT

An exercise device includes an actuator that provides resistance to a user. It further includes a sensor that senses the state of the actuator over time. It further includes an emergency event handler that receives a stream of information from the sensor and determines, based at least in part on the stream of information, a potential occurrence of an emergency condition.

3 Claims, 4 Drawing Sheets

CONDITION DETECTION

BACKGROUND OF THE INVENTION

Users may experience unexpected and undesirable situations when performing exercise in which they are unable to alert others or request help. Accordingly, for safety, there is a need for systems and techniques capable of first detecting such situations and events, and then providing appropriate responsive actions.

BRIEF DESCRIPTION OF THE DRAWINGS

Various embodiments of the invention are disclosed in the following detailed description and the accompanying drawings.

DETAILED DESCRIPTION

Figure 1A:
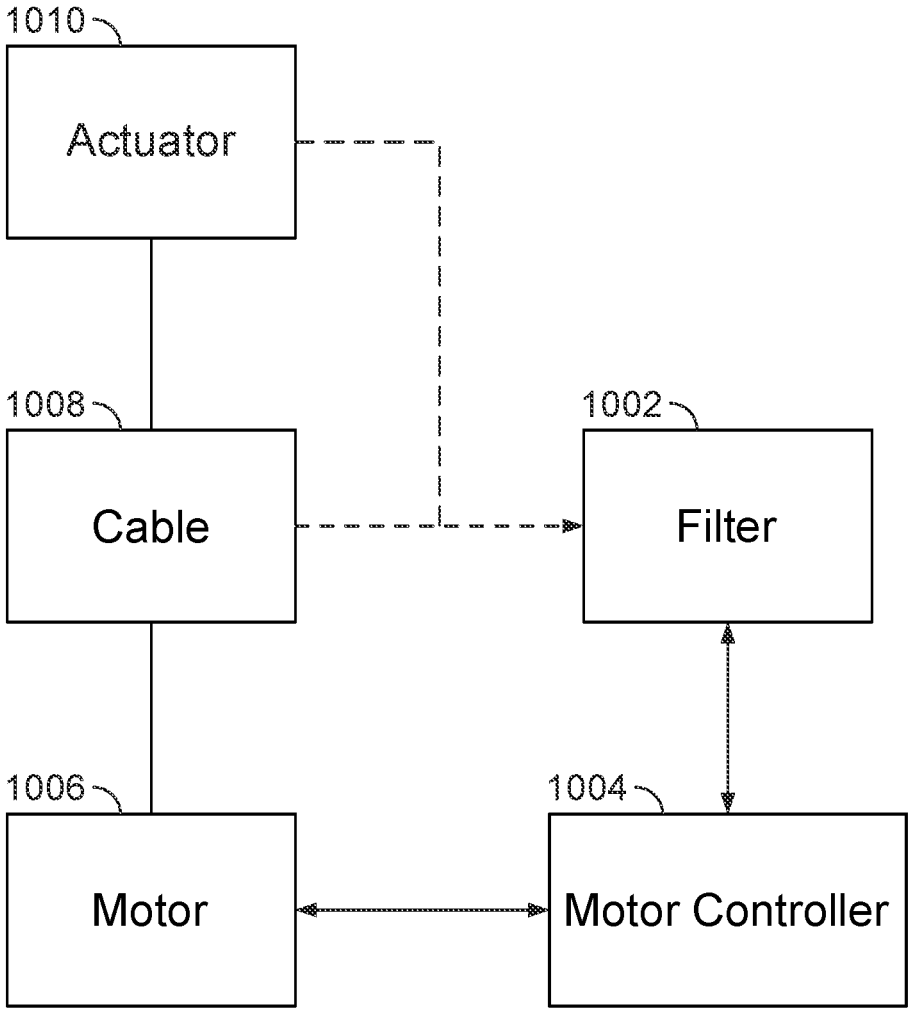
FIG. 1A illustrates an embodiment of an exercise machine.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Described herein are embodiments of detecting unexpected and undesirable conditions when performing strength training. When performing strength training, such as when using a digital strength trainer such as that described below, users may experience unexpected situations where they are unable to alert others to request help (e.g., for medical assistance). Described herein are techniques for detecting such situations, as well as to perform actions on behalf of users to resolve or mitigate the situations. While embodiments of condition detection and alerting in the context of performing strength training using a digital strength trainer are described herein for illustrative purposes, the techniques described herein may be variously adapted to accommodate any other type of exercise or exercise device, as appropriate.

As will be described in further detail below, various combinations of signals and information are used to evaluate the likelihood of the occurrence of a condition, examples of which include, but are not limited to:

- sensor inputs from the digital strength trainer (e.g., sudden stop; vibration or slack in rope; camera and microphone input; dropping of handles based on accelerometer signal)
- understanding of the user (e.g., exertion/struggle level as monitored during a workout)
- sensors or signals from other devices or accessories such as a phone, heart-rate monitor, etc.

Further embodiments and details regarding condition detection are described below.

Various actions may be taken in response to detection of a condition. For example, the user may be advised that an emergency situation has been detected and to stop exercising and seek help. An option may be provided to the user to turn off this alert and continue. In the case that the condition detection is unacknowledged, in some embodiments, communication channels on the digital strength trainer or other devices are utilized to, for example, attempt to reach emergency contacts using mechanisms designated by the user (e.g., messaging, SMS, phone calls, etc.). In some embodiments, users are provided mechanisms by which to intervene, such as a countdown timer with the ability to cancel an action.

In some embodiments, automatic remote monitoring is provided. The functionality of automatic remote monitoring may be based on user consent and settings. As one example set of automatic remote monitoring functionality:

- contacts are notified when a user begins a workout
- contacts are notified when a user ends a workout normally through the digital strength trainer user interface.
- contacts are alerted to a possible concern or potential emergency situation if the user suddenly stops mid-workout without confirming safety.

The following is another example set of automatic remote monitoring functionality:

In the case that an alerting condition occurs, additional sensors/communications devices, such as an embedded camera, microphone, and/or speaker of the strength trainer may be enabled or activated to allow, for example, an emergency contact to view a camera feed and/or listen to audio. The use/activation of additional sensors/devices in response to detection of a condition may be combined with other safety mechanisms described herein.

Further details and embodiments regarding actions taken in response to detection of a condition are described below.

Example Digital Strength Trainer

FIG. 1A illustrates an embodiment of an exercise machine. In particular, the exercise machine of FIG. 1A is an example of a digital strength training machine. In some embodiments, a digital strength trainer uses electricity to generate tension/resistance. Examples of electronic resistance include using an electromagnetic field to generate tension/resistance, using an electronic motor to generate tension/resistance, and using a three-phase brushless direct-current (BLDC) motor to generate tension/resistance. In various embodiments, the form detection and feedback techniques described herein may be variously adapted to accommodate other types of exercise machines using different types of load elements without limitation, such as exercise machines based on pneumatic cylinders, springs, weights, flexing nylon rods, elastics, pneumatics, hydraulics, and/or friction.

Such a digital strength trainer using electricity to generate tension/resistance is also versatile by way of using dynamic resistance, such that tension/resistance may be changed nearly instantaneously. When tension is coupled to position of a user against their range of motion, the digital strength trainer may apply arbitrary applied tension curves, both in terms of position and in terms of phase of the movement: concentric, eccentric, and/or isometric. Furthermore, the shape of these curves may be changed continuously and/or in response to events; the tension may be controlled continuously as a function of a number of internal and external variables including position and phase, and the resulting applied tension curve may be pre-determined and/or adjusted continuously in real time.

The example exercise machine of FIG. 1A includes the following:

- a motor controller circuit (1004), which in some embodiments includes a processor, inverter, pulse-width-modulator, and/or a Variable Frequency Drive (VFD);
- a motor (1006), for example, a three-phase brushless DC driven by the controller circuit (1004). While a single motor is shown in this example, other numbers of motors may be used. For example, dual motors may be used;
- a spool/hub with a cable (1008) wrapped around the spool and coupled to the spool. On the other end of the cable an actuator (1010) is coupled in order for a user to grip and pull on. Examples of actuators include handles and bars that are attached to the cables. The actuators may be attached to the cables at distal ends of the arms of the exercise machine, which are described in further detail below. The spool is coupled to the motor (1006) either directly or via a shaft/belt/chain/gear mechanism;
- a filter (1002), to digitally control the controller circuit (1004) based on receiving information from the cable (1008) and/or actuator (1010);
- optionally (not shown in FIG. 1A) a gearbox between the motor and spool. Gearboxes multiply torque and/or friction, divide speed, and/or split power to multiple spools. A number of combinations of motor and gearbox may also be used. A cable-pulley system may be used in place of a gearbox, and/or a dual motor may be used in place of a gearbox;
- one or more of the following sensors (not shown in FIG. 1A):
- encoders: In various embodiments, encoders are used to measure cable lengths (e.g., left and right cable lengths in this example), cable speeds, weight (tension), etc.

One example of an encoder is a position encoder; a sensor to measure position of the actuator (1010) or motor (1006). Examples of position encoders include a hall effect shaft encoder, grey-code encoder on the motor/spool/cable (1008), an accelerometer in the actuator/handle (1010), optical sensors, position measurement sensors/methods built directly into the motor (1006), and/or optical encoders. In one embodiment, an optical encoder is used with an encoding pattern that uses phase to determine direction associated with the low resolution encoder. As another example, a magnetic encoder is used to determine cable position/length. Other mechanisms that measure back-EMF (back electromagnetic force) from the motor (1006) in order to calculate position may also be used;

- a motor power sensor; a sensor to measure voltage and/or current being consumed by the motor (1006);
- a user tension sensor; a torque/tension/strain sensor and/or gauge to measure how much tension/force is being applied to the actuator (1010) by the user. In one embodiment, a tension sensor is built into the cable (1008). Alternatively, a strain gauge is built into the motor mount holding the motor (1006). As the user pulls on the actuator (1010), this translates into strain on the motor mount which is measured using a strain gauge in a Wheatstone bridge configuration. In another embodiment, the cable (1008) is guided through a pulley coupled to a load cell. In another embodiment, a belt coupling the motor (1006) and cable spool or gearbox (1008) is guided through a pulley coupled to a load cell. In another embodiment, the resistance generated by the motor (1006) is characterized based on the voltage, current, or frequency input to the motor.

Another example of sensors includes inertial measurement units (IMUs). In some embodiments, IMUs are used to measure the acceleration and rate of rotation of actuators. The IMUs may be embedded within or attached to actuators (e.g., in both handles or as an attachment on a bar).

In some embodiments, an IMU is placed on the cable (e.g., via a clip) to determine inertial measurements with respect to the cable. As another example, IMUs may be included in a device that clips onto an actuator accessory such as a bar handle.

Another example type of sensor used by the exercise machine includes cameras.

In some embodiments, the exercise machine includes an embedded camera.

In some embodiments, the exercise machine is communicatively coupled (either in a wired or wireless manner) with a dedicated accessory camera external to the exercise machine that is paired with the exercise machine. The dedicated accessory camera may be set up in a different location to the exercise machine, such as on an adjacent wall, above the exercise machine on the same wall, on a tripod, etc.

In some embodiments, the exercise machine is paired with an external device that has or is attached to a camera, where such devices include mobile phones, tablets, computers, etc.

Various types of cameras may be used. As one example, RGB cameras are used. As another example, cameras with depth-sensing capability are used.

In some embodiments, infrared cameras are used that measure heat, where in some embodiments such information is used to deduce quantities such as muscle exertion, soreness, etc.

In some embodiments, the sensors used by the exercise machine include accessories such as smart watches, with which the exercise machine may be communicatively coupled (e.g., via a wireless connection such as Bluetooth or WiFi). The readings from such sensors may then be used to monitor form.

Other examples of accessories that may be communicatively coupled with the exercise machine include: smart clothing that measures muscle engagement or movement; and smart mats or smart benches that measure spatial distribution of force when the user is on them.

In some embodiments, the exercise machine includes mechanisms to locate devices (e.g., actuators, IMUs, etc.) in 3-Dimensional space. As one example, Bluetooth Low Energy (BLE) spatial locationing (e.g., Angle of Arrival and Angle of Departure "AoA/AoD") is used to locate devices in 3-D space.

In one embodiment, a motor such as, but not limited to, an induction type of brushless motor. In one embodiment, a three-phase brushless DC motor (1006) is used with the following:

- a controller circuit (1004) combined with the filter (1002) that includes:
  - a processor that runs software instructions;
  - three pulse width modulators (PWMs), each with two channels, modulated at 20 kHz;
  - six transistors in an H-Bridge configuration coupled to the three PWMs;
  - optionally, two or three ADCs (Analog to Digital Converters) monitoring current on the H-Bridge; and/or
  - optionally, two or three ADCs monitoring back-EMF voltage;
- the three-phase brushless DC motor (1006), which in some embodiments includes a synchronous-type and/or asynchronous-type permanent magnet motor, such that:
  - the motor (1006) may be in an "out-runner configuration" as described below;
  - the motor (1006) may have a maximum torque output of at least 60 Nm and a maximum speed of at least 300 RPMs;
  - optionally, with an encoder or other method to measure motor position;
- a cable (1008) wrapped around the body of the motor (1006) such that the entire motor (1006) rotates, so the body of the motor is being used as a cable spool in one embodiment. Thus, the motor (1006) is directly coupled to a cable (1008) spool. In one embodiment, the motor (1006) is coupled to a cable spool via a shaft, gearbox, belt, and/or chain, allowing the diameter of the motor (1006) and the diameter of the spool to be independent, as well as introducing a stage to add a set-up or step-down ratio if desired. Alternatively, the motor (1006) is coupled to two spools with an apparatus in between to split or share the power between those two spools. Such an apparatus could include a differential gearbox, or a pulley configuration; In some embodiments, the two motors (dual motor configuration) are each coupled with a respective spool.
- an actuator (1010) such as a handle, a bar, a strap, or other accessory connected directly, indirectly, or via a connector such as a carabiner to the cable (1008).

In some embodiments, the controller circuit (1002, 1004) is programmed to drive the motor in a direction such that it draws the cable (1008) towards the motor (1006). The user pulls on the actuator (1010) coupled to the cable (1008) against the direction of pull of the motor (1006).

One example purpose of this setup is to provide an experience to a user similar to using a traditional cable-based strength training machine, where the cable is attached to a weight stack being acted on by gravity. Rather than the user resisting the pull of gravity, they are instead resisting the pull of the motor (1006).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (1010) coupled to a cable (1008) coupled to a motor (1006). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (1006) may be converted into linear force by multiplying it by radius r.

If the virtual/perceived "weight stack" is moving away from the ground, motor (1006) rotates in one direction. If the "weight stack" is moving towards the ground, motor (1006) rotates in the opposite direction. Note that the motor (1006) is pulling towards the cable (1008) onto the spool. If the cable (1008) is unspooling, it is because a user has overpowered the motor (1006). Thus, note a distinction between the direction the motor (1006) is pulling, and the direction the motor (1006) is actually turning.

If the controller circuit (1002, 1004) is set to drive the motor (1006) with, for example, a constant torque in the direction that spools the cable, corresponding to the same direction as a weight stack being pulled towards the ground, then this translates to a specific force/tension on the cable (1008) and actuator (1010). Referring to this force as "Target Tension," in one embodiment, this force is calculated as a function of torque multiplied by the radius of the spool that the cable (1008) is wrapped around, accounting for any additional stages such as gear boxes or belts that may affect the relationship between cable tension and torque. If a user pulls on the actuator (1010) with more force than the Target Tension, then that user overcomes the motor (1006) and the cable (1008) unspools moving towards that user, being the virtual equivalent of the weight stack rising. However, if that user applies less tension than the Target Tension, then the motor (1006) overcomes the user and the cable (1008) spools onto and moves towards the motor (1006), being the virtual equivalent of the weight stack returning.

Motor. While many motors exist that run in thousands of revolutions per second, an application such as fitness equipment designed for strength training has different requirements and is by comparison a low speed, high torque type application suitable for certain kinds of motors configured for lower speed and higher torque.

In one embodiment, a specification of such a motor (1006) is that a cable (1008) wrapped around a spool of a given diameter, directly coupled to a motor (1006), behaves like a 200 lbs weight stack, with the user pulling the cable at a maximum linear speed of 62 inches per second. The aforementioned weight and linear speed specifications are but examples for illustrative purposes, and the system may be configured to behave to different specifications. A number of motor parameters may be calculated based on the diameter of the spool.

User Requirements
Target Weight 200 lbs
Target Speed 62 inches/sec = 1.5748 meters/sec
Requirements by Spool Size

| Diameter (inches) | 3 | 5 | 6 | 7 | 8 | 9 |
|---|---|---|---|---|---|---|
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements.

Hub motors are three-phase permanent magnet BLDC direct drive motors in an "out-runner" configuration: throughout this specification, the "out-runner" configuration refers to the permanent magnets being placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style." As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As one example, a pancake motor is between 15 and 60 centimeters in diameter, for example, 22 centimeters in diameter, with a depth between 6 and 15 centimeters, for example, a depth of 6.7 centimeters.

Motors may also be "direct drive," meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor torque is more appropriate for fitness equipment/strength training systems. This would typically lead to the selection of an induction type motor for which direct control of torque is simple. Although BLDC motors are more directly able to control speed and/or motor position rather than torque, torque control of BLDC motors can be made possible when used in combination with an appropriate encoder.

Trainer Intelligence. When a user is performing an exercise, the part of their body being exercised moves through a range of motion necessary to perform that exercise. For example, a bicep exercise might move from the elbow being fully extended wherein the bicep muscle is fully elongated, to the elbow being fully bent wherein the bicep is fully contracted. This presents an opportunity for "Trainer Intelligence" as described below.

In some embodiments, for a user performing the exercise with the system of FIG. 1A, during this motion the cable (1008) may move through a range of motion which corresponds to a range of motion for the cable (1008), spool, and motor (1006) of the system, if a motor is being used. In some embodiments, changes in cable (1008) position may correspond to changes in the readings of various sensors and in the physical position of various actuators such as linear electro-magnetic-mechanical, pneumatic, and so forth. This range of motion is termed "percent range of motion", which ranges from 0% to 100%, with the convention that 0% represents the beginning of the range of motion when the elbow is fully extended, and 100% represents the end of the range of motion when the elbow if fully bent. Both actual and ideal range of motion is considered. Actual range of motion is that a current user enacts, and ideal range of motion is that which a user should enact for an ideal or intended exercise.

Strength training exercises are divided into sets. Each set includes one or more repetitions. A user typically performs one or more sets of a given exercise. In order to determine a percent range of motion, the systems in FIG. 1A may first calibrate itself, and may then also make dynamic adjustments. This is possible because the user performs several repetitions of every movement. The first time a user performs a given movement/exercise, a start position, an end position, and stride length, the end position minus the start position, may be recorded. The end position may be the point at which the direction of movement changes from the direction corresponding to the weight stack moving away from the ground to the direction corresponding to the weight stack moving towards the ground. The start position may be the point at which the direction of movement changes from the direction corresponding to the weight stack moving towards the ground to the direction corresponding to the weight stack moving away from the ground. In one embodiment, calibration and/or adjustment may be based on recordings from each movement in a set. Alternatively, calibration and/or adjustment may be based on recordings over multiple sets, such that the results over time are combined and stored for use in future sets.

A user may momentarily change direction of travel at a point that does not demark the beginning or end of a repetition. This may happen if a user is struggling. Such movements may be filtered out for the purposes of determining range of motion, or noted in another way.

Constantly recording and updating the start point, end point, and the calculated stride length are important to calculations. Points change over time, as a user taking a step away from the machine shifts the start and end points the equivalent distance. If the stride length has not changed, the true range of motion may not be changed but be offset, which may be filtered or dealt with appropriately with a calculated offset. The start points and end points may be updated with each repetition, or an average, moving average, or weighted average of the last plurality of recorded samples are used, and may include samples from previous sets.

In some embodiments, range of motion and repetitions are extracted from a series of position updates. Hysteresis is used to filter out small movements that may be mistaken for a new repetition, such as when a user is struggling, and this learns over time by averaging the position of the start and end of the range of motion. Averaging may also occur over weighted averages and/or moving averages. Sample code includes:

```
// Repetition Extraction from position data. (this function is to be called every time the
// position of the virtual weight stack changes). It will extract segments (each rep is 2
// segments), and calculate the position in (% of range of motion) as it learns the range
// of motion.
void processRe(int32 newpos) {
 // newpos is the virtual position of the weight stack at the current moment. GROUND is a
 // constant that indicates the lowest possible position the weight stack can take.
 // g_ReEndSetFlag is a global flag that indicates to this rep extraction algorithm that
 // the current set has come to an end, an a new set should begin. This can be user initiated
 // or be based on a timer (when newpos <= GROUND, start a timer, and if the weight stack
 // doesn't move above ground after a certain amount of time threshold (say 10 seconds), we
 // can declare the set over.
 if(g_ReEndSetFlag && newpos <= GROUND) {
  g_ReSegCount = 0; // which will trigger a full reset in the if statement below
  g_ReEndSetFlag = 0;
 }
 if(g_ReLow >=g_ReHigh && g_ReSegCount > 0) {
  g_ReSegCount = 0;
 }
 // Now we're starting a new set!
 if(newpos <= GROUND && g_ReSegCount <= 0) {
  g_ReDirUp = 1; // the direction the weight stack is moving (up or down)
  g_ReSegUp = 1; // each rep has two segments, an up and a down segment. This stores
        // the direction of the current segment
  g_RePos = GROUND; // the previous position of the weight stack
  g_RePercent = 0; // percent position into the range of motion. 0% is the start of the
        // range of motion, and 100% is the end of the range of motion
  g_ReSegCount = 0; // counts the number of segments (2 segments per rep)
  g_ReLow = GROUND; // This is the position of the (average) beginning of the range of motion
  g_ReHigh = -1; // Like ReLow, but it's the end; -1 => we won't use these until initialized
  // The next two thresholds are used to implement hysteresis, were the weight stack reversing
  // direction does not count as a new segment unless it's gone past the appropriate threshold
  g_ReHighThreshold = -1; // The threshold for going from Up to Down
  g_ReLowThreshold = -1; // The threshold for going from Down to Up
  g_ReFlag = 0; // A flag that indicates that a change in direction was ignores because it
        // didn't comply with one of the above two thresholds
  g_RePercent = 0; // Global, and the output of this function; represents the position as
        // a percent of range of motion
  return;
 } else if(newpos < GROUND) {
  newpos = GROUND; // filter out what happens down there ;)
 }
 if(g_ReLow >= g_ReHigh && g_ReSegCount > 0) {
  g_RePercent = 0; // This should never happen
 } else if(g_ReSegCount < 2) {
  g_RePercent = 0; // percent isn't useful until a full repetition has completed (that's 2
  // segments; one on the way up, and one on the way down
 } else {
  // Multiply by 1000 since we are calculating 10th's of a percent (fixed point)
  g_RePercent = (int)((int32)(newpos - g_ReLow) * (int32)1000L /(int32)(g_ReHigh - g_ReLow));
 }
 if(g_ReDirUp) {
  if(newpos < g_RePos) {
   // wow, direction changed!
   g_ReDirUp = 0;
   if(g_ReFlag) {
    g_ReFlag = 0;
   } else if(newpos < g_ReHighThreshold && g_ReSegCount > 1) {
    g_ReFlag = 1;
    g_ReFlagCount++;
   } else if(newpos < 6000 && g_ReSegCount == 0) {
    g_ReFlag = 1;
    g_ReFlagCount++;
   } else {
    // Let's record the "high" position
    if(g_ReSegCount < 2) {
```

-continued

```
      g_ReHigh = g_RePos; // first segment, just record
     } else {
      // Moving average for future segments
      g_ReHigh = (g_ReHigh * 3 + g_RePos * 7) / 10;
     }
     // We have a new high point; let's update the thresholds
     g_ReHighThreshold = (g_ReLow + (int32)2L*g_ReHigh) / (int32)3L;
     g_ReLowThreshold = ((int32)2L*g_ReLow + g_ReHigh) / (int32)3L;
     if(g_ReSegCount == 0) {
        // First half of the first rep; let's set the low threshold
        // such that minimum rep length is 10 cm
        g_ReLowThreshold = g_ReHighThreshold - g_AsTicksPerMm * 100L;
     }
     g_ReSegCount++;
     g_ReFlag= 0;
     g_ReFlagCount = 0;
     g_ReSegUp = g_ReDirUp;
     g_ReFlagGround = 0; // reset the ground flag
     // Notify a listener that a up segment has completed (this is a place where
     // any code relying on repetition extraction can make decisions at the end of a
     // up segment)
     onReEndOfUpSegment(newpos);
    }
   }
  } else {
   if(newpos > g_RePos) {
    // wow, direction changed!
    g_ReDirUp = 1;
    if(g_ReFlag) {
     TEST_PRINTF(": %-10d LOW\n", g_RePos);
     g_ReFlag = 0;
    } else if(newpos > g_ReLowThreshold && g_ReSegCount > 0) {
     TEST_PRINTF("! %-10d LOW       [Threshold = %d]\n", g_RePos, g_ReLowThreshold);
     g_ReFlag = 1;
    } else {
     // Let's record the "high" position
     if(g_ReSegCount < 2) {
      g_ReLow = g_RePos; // first segment, just record
     } else {
      // Moving average for future segments
      g_ReLow = (g_ReLow * 3 + g_RePos * 7) / 10;
     }
     // We have a new low point; let's update the thresholds
     g_ReHighThreshold = (g_ReLow + 2*g_ReHigh) / 3;
     g_ReLowThreshold = (2*g_ReLow + g_ReHigh) / 3;
     g_ReSegCount++;
     g_ReFlag = 0;
     g_ReFlagCount = 0;
     g_ReSegUp = g_ReDirUp;
     // Notify a listener that a down segment has completed (this is a place where
     // any code relying on repetition extraction can make decisions at the end of a
     // down segment)
     onReEndOfDownSegment(newpos);
    }
   } else if(newpos <= GROUND) {
    if(!g_ReFlagGround) {
     // Notify a listener that the weight stack has reached the ground (this is a place
     // where any code relying on repetition extraction can make decisions that are to be
     // make when the weight stack returns to the ground)
     onRegGround( );
    }
    g_ReFlagGround = 1;
   }
  }
  g_RePos = newpos;
}
```

Significant changes in stride are noted as they indicate that the user is not completing the full range of motion on the exercise. This is particularly true if the start point is the same, but the end point has changed resulting in a reduced range of motion. This may be an indication of a user that is fatigued or being lazy.

In some embodiments, significant changes in stride are detected through the use of thresholds. For example, a reasonable range of motion for a healthy repetition begins at between 0% and 10%, and ends at between 90% and 100%. If the user ends a repetition at a lower point, such as 83% rather than greater than 90%, then this is considered a significant reduction in range of motion, at which point a user may be alerted and/or coached.

The concentric phase of an exercise is reflected when range of motion is increasing, for example 0% to 100%, and the eccentric phase of an exercise is reflected when range of motion is decreasing, for example from 100% to 0%. The bounds of 0% and 100% need not be actually reached as the user may be lazy or exceeding their average. When range of motion changes from increasing to decreasing, or decreasing to increase, is sufficient to determine a transition from concentric to eccentric or eccentric to concentric.

Figure 1B:
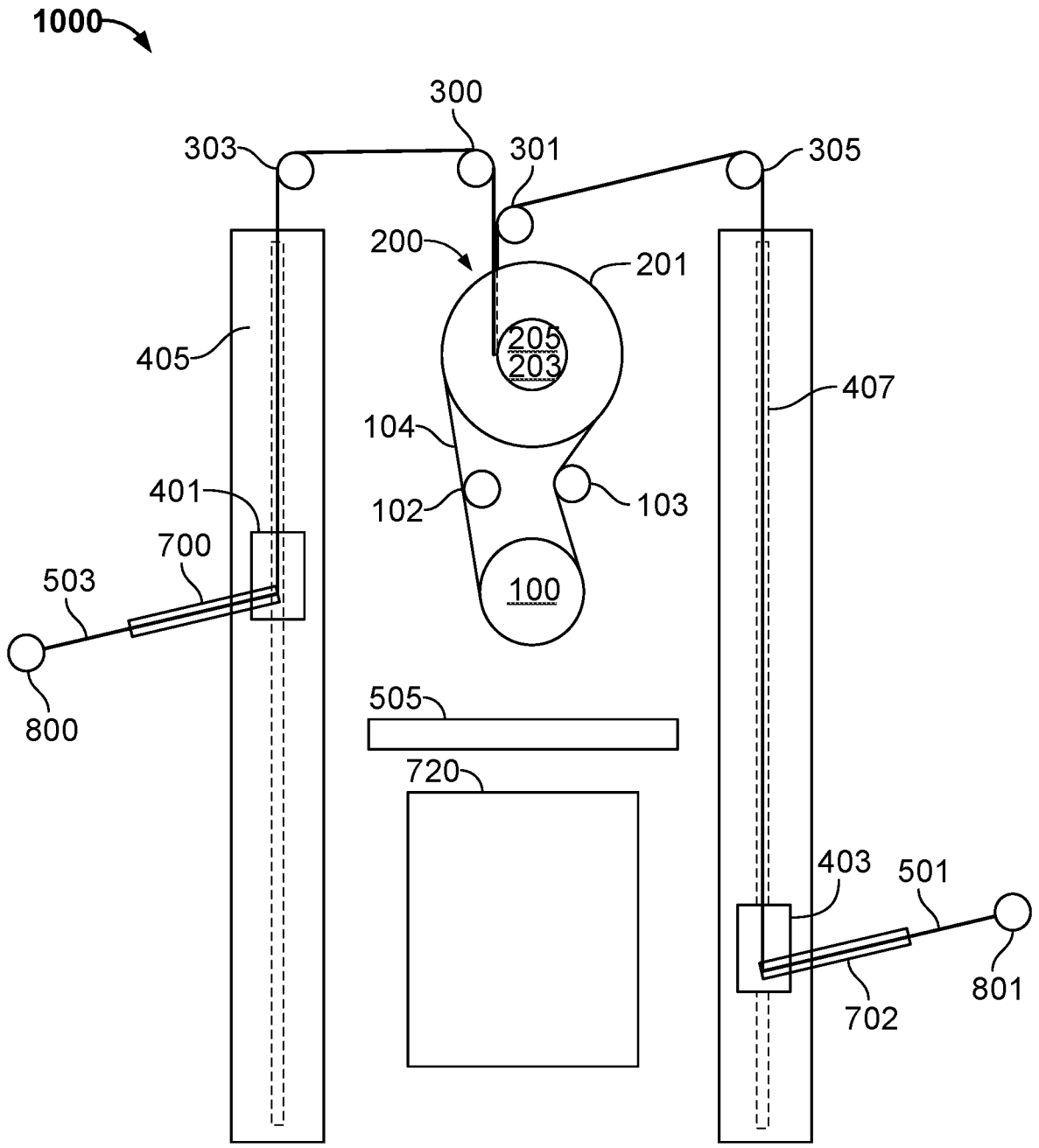
FIG. 1B illustrates a front view of one embodiment of an exercise machine.

FIG. 1B illustrates a front view of one embodiment of an exercise machine. In some embodiments, exercise machine 1000 of FIG. 1B is an example or alternate view of the exercise machine of FIG. 1A. In this example, exercise machine (1000) includes a pancake motor (100), a torque controller coupled to the pancake motor, and a high resolution encoder coupled to the pancake motor (102). As used herein, a "high resolution" encoder refers to an encoder with 30 degrees or greater of electrical angle. In this example, two cables (503) and (501) are coupled respectively to actuators (800) and (801) on one end of the cables. The two cables (503) and (501) are coupled directly or indirectly on the opposite end to the motor (100). While an induction motor may be used for motor (100), a BLDC motor may also be used for its cost, size, weight, and performance. In some embodiments, a high resolution encoder assists the system to determine the position of the BLDC motor to control torque. While an example involving a single motor is shown, the exercise machine may include other configurations of motors, such as dual motors, with each cable coupled to a respective motor.

Sliders (401) and (403) may be respectively used to guide the cable (503) and (501) respectively along rails (405) and (407). The exercise machine in FIG. 1B translates motor torque into cable tension. As a user pulls on actuators (800) and/or (801), the machine creates/maintains tension on cable (503) and/or (501). The actuators (800, 801) and/or cables (503, 501) may be actuated in tandem or independently of one another.

In one embodiment, electronics bay (720) is included and has the necessary electronics to drive the system. In one embodiment, fan tray (505) is included and has fans that cool the electronics bay (720) and/or motor (100).

Motor (100) is coupled by belt (104) to an encoder (102), an optional belt tensioner (103), and a spool assembly (200). In one embodiment, motor (100) is an out-runner, such that the shaft is fixed and the motor body rotates around that shaft. In one embodiment, motor (100) generates torque in the counter-clockwise direction facing the machine, as in the example in FIG. 1B. Motor (100) has teeth compatible with the belt integrated into the body of the motor along the outer circumference. Referencing an orientation viewing the front of the system, the left side of the belt (104) is under tension, while the right side of the belt is slack. The belt tensioner (103) takes up any slack in the belt. An optical rotary encoder (102) coupled to the tensioned side of the belt (104) captures all motor movement, with significant accuracy because of the belt tension. In one embodiment, the optical rotary encoder (102) is a high resolution encoder. In one embodiment, a toothed belt (104) is used to reduce belt slip. The spools rotate counter-clockwise as they are spooling cable/taking cable in, and clockwise as they are unspooling/releasing cable out.

Spool assembly (200) comprises a front spool (203), rear spool (205), and belt sprocket (201). The spool assembly (200) couples the belt (104) to the belt sprocket (201), and couples the two cables (503) and (501) respectively with spools (205) and (203). Each of these components is part of a low profile design. In one embodiment, a dual motor configuration not shown in FIG. 1B is used to drive each cable (503) and (501). In the example shown in FIG. 1B, a single motor (100) is used as a single source of tension, with a plurality of gears configured as a differential are used to allow the two cables/actuators to be operated independently or in tandem. In one embodiment, spools (205) and (203) are directly adjacent to sprocket (201), thereby minimizing the profile of the machine in FIG. 1B.

As shown in FIG. 1B, two arms (700, 702), two cables (503, 501) and two spools (205, 203) are useful for users with two hands, and the principles disclosed without limitation may be extended to three, four, or more arms (700) for quadrupeds and/or group exercise. In one embodiment, the plurality of cables (503, 501) and spools (205, 203) are driven by one sprocket (201), one belt (104), and one motor (100), and so the machine (1000) combines the pairs of devices associated with each user hand into a single device. In other embodiments, each arm is associated with its own motor and spool.

In one embodiment, motor (100) provides constant tension on cables (503) and (501) despite the fact that each of cables (503) and (501) may move at different speeds. For example, some physical exercises may require use of only one cable at a time. For another example, a user may be stronger on one side of their body than another side, causing differential speed of movement between cables (503) and (501). In one embodiment, a device combining dual cables (503) and (501) for a single belt (104) and sprocket (201) retains a low profile, in order to maintain the compact nature of the machine, which can be mounted on a wall.

In one embodiment, pancake style motor(s) (100), sprocket(s) (201), and spools (205, 203) are manufactured and arranged in such a way that they physically fit together within the same space, thereby maximizing functionality while maintaining a low profile.

As shown in FIG. 1B, spools (205) and (203) are respectively coupled to cables (503) and (501) that are wrapped around the spools. The cables (503) and (501) route through the system to actuators (800) and (801), respectively.

The cables (503) and (501) are respectively positioned in part by the use of "arms" (700) and (702). The arms (700) and (702) provide a framework for which pulleys and/or pivot points may be positioned. The base of arm (700) is at arm slider (401) and the base of arm (702) is at arm slider (403).

The cable (503) for a left arm (700) is attached at one end to actuator (800). The cable routes via arm slider (401) where it engages a pulley as it changes direction, then routes along the axis of rotation of track (405). At the top of rail/track (405), fixed to the frame rather than the track, is pulley (303) that orients the cable in the direction of pulley (300), that further orients the cable (503) in the direction of spool (205), wherein the cable (503) is wound around spool (205) and attached to spool (205) at the other end.

Similarly, the cable (501) for a right arm (702) is attached at one end to actuator (801). The cable (501) routes via slider (403) where it engages a pulley as it changes direction, then routes along the axis of rotation of rail/track (407). At the top of the rail/track (407), fixed to the frame rather than the track is pulley (305) that orients the cable in the direction of pulley (301), that further orients the cable in the direction of spool (203), wherein the cable (501) is wound around spool (203) and attached to spool (203) at the other end.

One use of pulleys (300, 301) is that they permit the respective cables (503, 501) to engage respective spools (205, 203) "straight on" rather than at an angle, wherein "straight on" references being within the plane perpendicular to the axis of rotation of the given spool. If the given cable were engaged at an angle, that cable may bunch up on one side of the given spool rather than being distributed evenly along the given spool.

In the example shown in FIG. 1B, pulley (301) is lower than pulley (300). This demonstrates the flexibility of routing cables. In one embodiment, mounting pulley (301) leaves clearance for certain design aesthetic elements that make the machine appear to be thinner.

In one embodiment, the exercise machine/appliance passes a load/resistance against the user via one or more lines/cables, to a grip(s) (examples of an actuator) that a user displaces to exercise. A grip may be positioned relative to the user using a load arm and the load path to the user may be steered using pulleys at the load arm ends, as described above. The load arm may be connected to a frame of the exercise machine using a carriage that moves within a track that may be affixed to the main part of the frame. In one embodiment, the frame is firmly attached to a rigid structure such as a wall. In some embodiments, the frame is not mounted directly to the wall. Instead, a wall bracket is first mounted to the wall, and the frame is attached to the wall bracket. In other embodiments, the exercise machine is mounted to the floor. The exercise machine may be mounted to both the floor and the wall for increased stability. In other embodiments, the exercise machine is a freestanding device.

In some embodiments, the exercise machine includes a media controller and/or processor, which monitors/measures user performance (for example, using the one or more sensors described above), and determines loads to be applied to the user's efforts in the resistance unit (e.g., motor described above). Without limitation, the media controller and processor may be separate control units or combined in a single package. In some embodiments, the controller is further coupled to a display/acoustic channel that allows instructional information to be presented to a user and with which the user interacts in a visual manner, which includes communication based on the eye such as video and/or text or icons, and/or an auditory manner, which includes communication based on the ear such as verbal speech, text-to-speech synthesis, and/or music. Collocated with an information channel is a data channel that passes control program information to the processor which generates, for example, exercise loading schedules. In some embodiments, the display is embedded or incorporated into the exercise machine, but need not be (e.g., the display or screen may be separate from the exercise machine, and may be part of a separate device such as a smartphone, tablet, laptop, etc. that may be communicatively coupled (e.g., either in a wired or wireless manner) to the exercise machine). In one embodiment, the display is a large format, surround screen representing a virtual reality/alternate reality environment to the user; a virtual reality and/or alternate reality presentation may also be made using a headset. The display may be oriented in landscape or portrait.

In one embodiment, the appliance media controller provides audio information that is related to the visual information from a program store/repository that may be coupled to external devices or transducers to provide the user with an auditory experience that matches the visual experience. Control instructions that set the operational parameters of the resistance unit for controlling the load or resistance for the user may be embedded with the user information so that the media package includes information usable by the controller to run the machine. In this way a user may choose an exercise regime and may be provided with cues, visual and auditory as appropriate, that allow, for example, the actions of a personal trainer to be emulated. The controller may further emulate the actions of a trainer using an expert system and thus exhibit artificial intelligence. The user may better form a relationship with the emulated coach or trainer, and this relationship may be encouraged by using emotional/mood cues whose effect may be quantified based on performance metrics gleaned from exercise records that track user performance in a feedback loop using, for example, the sensor(s) described above.

Figure 2:
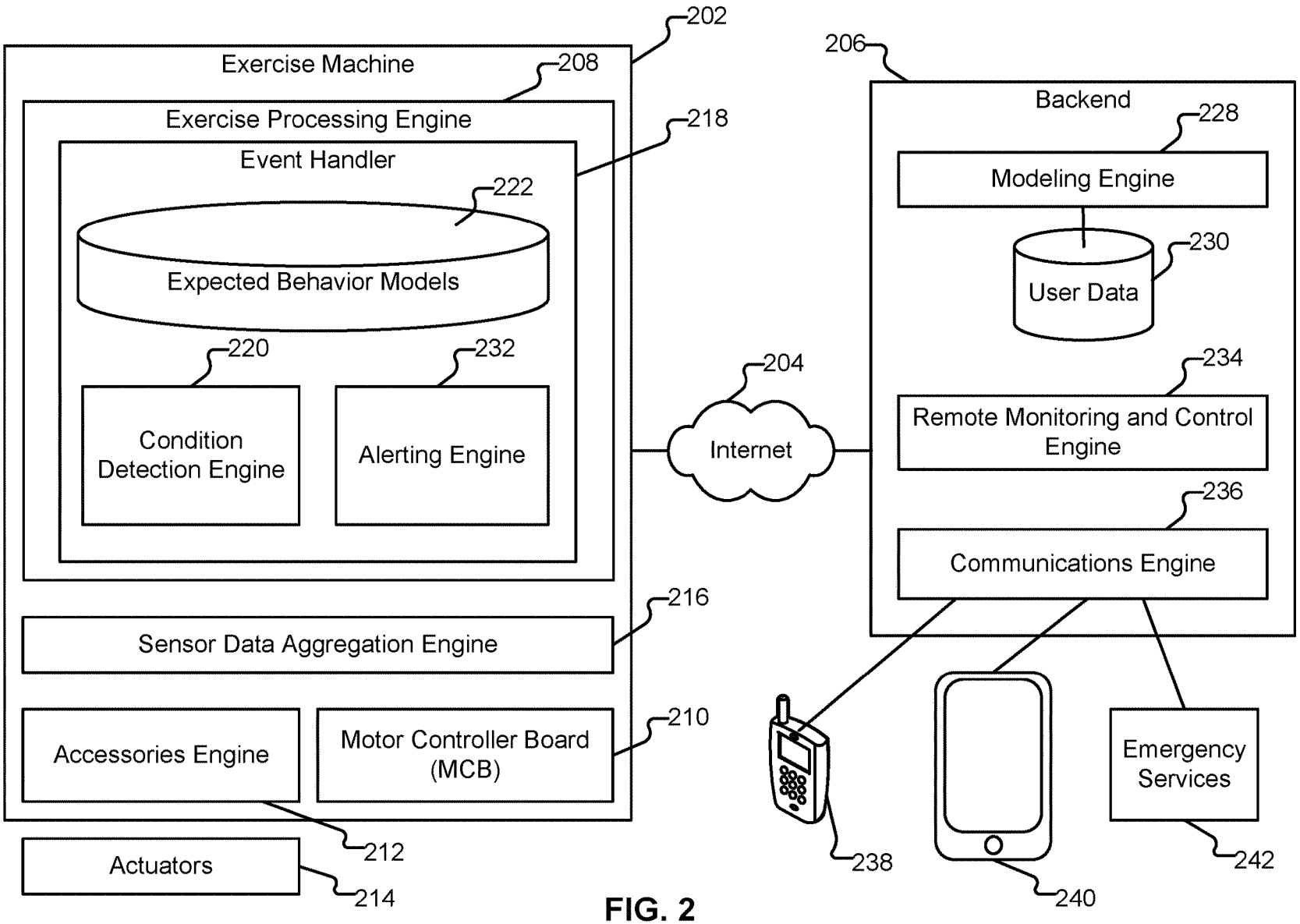
FIG. 2 illustrates an embodiment of a system for condition detection and alerting.

FIG. 2 illustrates an embodiment of a system for condition detection and alerting. In this example, exercise machine 202 is an alternate view of the exercise machine embodiments shown in FIGS. 1A and 1B. As shown in this example, exercise machine 202 also communicates (over a network 204 such as the Internet) with backend 206.

In this example, exercise machine 202 includes exercise processing engine 208, motor controller board 210 (an example of motor controller 1004), accessories engine 212, and actuators 214. In some embodiments, these elements are compute/sensor nodes that form a computation architecture/stack in which sensor measurements are taken, and computations on such sensor measurements are made, at various levels.

In this example, at the bottom level/layer of the stack are actuators/accessories 214, examples of which include handles, bar controllers, smart mats, etc. In some embodiments, the sensors at the level of actuators 214 include IMUs (which may include gyroscopes and accelerometers), buttons, force sensors, etc.

At the next level of the computation architecture is accessories engine 212. Accessories engine 212 is configured to aggregate sensor data from the actuators. As one example, accessories engine 212 is implemented using the BLE (Bluetooth Low Energy) Central plugin, which communicates with accessories (e.g., via BLE, USB, RF, etc.). In some embodiments, the accessories engine is configured to determine the positions of accessories/actuators in physical space.

At the next level of the computation stack is motor controller board (MCB) 210. MCB 210 is another example of a computation node/layer in the computation architecture. In this example, the motor controller board collects data such as cable position and speed, motor position and speed, cable tension, scalable stack information (e.g., health of the motor, board, processor/memory of the board, and communication), etc. As one example, the motor controller board (MCB) is configured to receive encoder messages and determine right and left cable lengths. In some embodiments, the MCB provides such sensor readings to sensor data aggregation engine 216. The information may be sent via a communication bus such as a USB (Universal Serial Bus). The information may be sent periodically (e.g., at a frequency of 50 Hz).

In the next layer of the computation architecture is exercise processing engine 208. In some embodiments, exercise processing engine 208 is a portion of an application running on a computing device included or otherwise associated with the exercise machine. As one example, the application is an Android application running on a computing device such as an Android tablet or computing device embedded in the exercise machine.

In this example, exercise processing engine 208 includes event handler 218. In some embodiments, the event handler is configured to detect unexpected conditions and handle such events. In this example, the event handler includes condition detection engine 220. In some embodiments, the condition detection engine is configured to detect events by detecting deviations from expected or baseline exercise behaviors. The baseline behaviors may be encoded in models of expected behavior models 222. In some embodiments, the baseline models of expected usage of the strength trainer are generated based on expected sensor measurements for various movements, global expected user behavior determined across information from multiple client trainers, as well as personalized behavior determined for individual users. Further details regarding event detection are described below.

The event handler further includes alerting engine 232. In some embodiments, the alerting engine is configured to handle events by performing actions responsive to detected events. The actions may include those that are determined and performed locally by the trainer. The actions may also include providing information or signals to backend 206, where the backend may then perform further actions in response to detection of an event at the client trainer. For example, in some embodiments, remote monitoring and control engine 234 of backend 206 is configured to provide a monitoring service. In some embodiments, the monitoring service utilizes communications engine 236 to provide messages to various entities such as emergency services 242, as well as to devices of contacts, such as smartphones 238, tablet devices 240, etc. In some embodiments, the remote monitoring and control engine 234 may be used to remotely control the exercise machine 202 in order to handle a detected event. Further details regarding event handling are described below.

The next layer of the computation architecture includes backend 206. As described above, in some embodiments, the backend includes a modeling engine (228) that is configured to use sensor, user, and workout data aggregated from various client trainers (e.g., user data 230) to determine various models of expected behavior (as well as statistics for determining thresholds for detecting conditions) that may be sent to client machines to perform condition detection.

As described above, in some embodiments, the backend also provides a monitoring service (e.g., remote monitoring and control engine 234) that may be used to send messages or alerts to various entities (e.g., via communications engine 236), as well as perform other processing, such as remote control of the trainer. In one embodiment, backend 206 is implemented on Amazon EC2 instances.

As shown in this example, data and data streams, such as sensors and user information/preferences, are distributed throughout the system/computation architecture.

In some embodiments, condition detection is based on streams of information collected from multiple sensors. Data may be fused, correlated, or analyzed at any compute node in a process referred to herein as "sensor fusion." The sensor data may also be passed through or pushed downwards to be operated on by various compute nodes in the computation stack.

As one example, suppose that the actuators 214 being used are two handles. The measurements taken from sensors (e.g., IMUs) in the two handles are passed to accessories engine 212 of the exercise machine, which aggregates, for example, sensor readings from all actuators. The actuator sensor data is then passed to exercise processing engine 208.

Sensor information collected by MCB 210 is also passed to sensor data aggregation engine 216. As shown in this example, sensor data aggregation engine 216 is configured to collect and aggregate the various and disparate sensor information (e.g., IMU sensor data, cable/motor/tension sensor data, audiovisual data from embedded camera(s), etc.). Other types of sensor information that can be aggregated include information from smart accessories such as smart mats (e.g., which may include a stream of pressure updates to determine whether a person is imbalanced, is falling, etc.), information from cameras external to the trainer (e.g., on a mobile phone that has installed an app corresponding to the trainer, or other secondary camera), heart rate monitors, oxygen sensors, etc. Condition detection engine 220 is then configured to perform condition detection using the combined sensor data.

In some embodiments, data, such as workout data (e.g., from MCB 210) and accessory data (e.g., smart bench data), is provided to backend 206 (e.g., as data to perform modeling of expected patterns of usage of an exercise machine).

In various embodiments, event detection and handling is performed at any of the above compute nodes in the computation architecture. In some embodiments, the algorithms and logic to perform the aforementioned event detection and handling are distributed across the entire stack with interfaces between each to obtain optimal performance and accuracy, along with low latency. For example, tasks that require latency that is lower than is possible based on communication between layers are done at lower levels. When latency can be higher or when data is taken in aggregate (e.g., across an entire workout), algorithms are run at higher levels where more computational power and contextual data is available.

Further details regarding exercise event detection and handling are described below.

Condition Detection

As described above, in some embodiments, condition detection engine (220) is configured to determine the potential occurrence of an (emergency) condition. Various embodiments of event/condition detection are described below.

As described above, throughout workouts using the strength trainer, a stream of sensor data is accumulated over time regarding various parameters or aspects of the workout. As one example, the sensor readings include readings from accelerometers embedded in the handles used by the user. As another example, the position (e.g., amount of retraction/extension) of the cable is determined from position updates (e.g., via encoders on the motor). As another example, the torque applied by the motor to provide resistance may also be determined. As yet another example, the amount of tension being applied by the user may also be continuously monitored. Information pertaining to the workout, such as the number of repetitions that have been performed so far, the volume load (where as one example the volume load is determined as weight multiplied by number of reps) lifted so far by the user, etc. may also be monitored.

The following are examples of sensor measurements and workout parameters that are monitored by the exercise machine (which may in turn be used to generate other parameters that are monitored). Over time, the exercise machine receives a stream of samples of sensor data.

Example Sensor Signals/User Parameters/Workout Parameters (e.g., aggregated by the sensor data aggregation engine):

- Left and right Cable Speed
- Left and right Cable Position
- Motor Position (Left and right if applicable, such as in a dual motor configuration)
- Motor Torque (Left and right if applicable, such as in a dual motor configuration)
- User Applied Force (Left and right if applicable, such as in a dual motor configuration)
- Left and right Actuator Accelerations (e.g., from IMUs)
- Weight on/off signal from activation of button on a smart handle
- Accelerometer of tablet IMU inside the body of the exercise machine (e.g., to determine whether exercise machine is improperly or loosely mounted to a wall, or has completely detached from the wall)

Camera input (e.g., from embedded camera of trainer, camera of connected smart phone, other external cameras, etc.)

Microphone input

User exertion/struggle level, as monitored during a workout

Maximum number of reps for a workout at a projected weight

One rep maximum

Heart Rate (e.g., from heart rate monitor or heart rate accessory)

IMU in a wearable device (e.g., as in a fitness tracker wristband, smart watch, or smart ring)

Radar

Non-visible light camera (e.g., infrared, thermal, or ultraviolet frequency spectrums)

Force-sensing surfaces (e.g., a floor mat or bench that measures force or pressure on its surfaces)

Respiratory rate

Such sensor measurements may be used to determine the occurrence of unexpected or unintended or unpredicted or unknown behavior. For example, the sensor measurements may be used to determine whether there is unexpected behavior, or an abrupt change in behavior, from a baseline or predicted performance for a particular exercise being performed.

In some embodiments, various models are used to determine, for an exercise being performed, a baseline pattern of usage of the trainer. In some embodiments, this baseline or expected pattern of usage of the trainer is based on a selection of baseline values or ranges for a combination of one or more parameters of the trainer. For example, for a given exercise, a baseline range of motion, baseline speed/velocity, etc. may be determined as the expected pattern of usage of the trainer when a typical user is performing the given movement. The baseline may also be personalized based on a model of the specific user performing the exercise, where in some embodiments, the personalized user model is generated based on historical workout data associated with the user. For example, over time, the trainer may accumulate information on the number of times or the frequency at which a user has been spotted (e.g., automatic weight reduction mid repetition due to detected fatigue) for an exercise. The trainer may also maintain a record of the average range of motion for the user, as well as the average power of the user, both of which may also be further determined on a per-movement repetition basis. For example, the user model may include information that for a bench press, the user's range of motion is typically within a minimum cable position and maximum cable position across the repetitions of a set, where the user is, on average, spotted 1.5 times per set. An average is but one example of an aggregate or cumulative metric that may be determined for the user. As shown in this example, combinations of multiple input factors may be used to determine a baseline or expected pattern of usage of the trainer.

In some embodiments, a baseline usage pattern of the trainer is generated for each type of movement, where the baseline usage pattern may also be personalized for a user (if there is sufficient historical information to do so). In addition to, or instead of the user historical information, the baseline usage pattern of the trainer may be generated based on workout performance information pertaining to other users (e.g., if the user is a new user, and personalized workout performance information pertaining to them has not yet been accumulated). Baselines for different types of exercise may be based on different combinations of factors, with threshold/ranges specific to the exercise.

The following are examples of parameters that may be determined from collected or aggregated sensor measurements, and which in various embodiments are used to determine components of a baseline usage pattern of the trainer. The baseline patterns or behavior models may be generated on a per-user and/or per-movement basis.

Examples of Components of a Usage Pattern:

expected time of completion of a repetition and/or set expected number of repetitions completed by a user before spotting expected range of motion expected retraction/extraction of left and right cables at different portions of a repetition (e.g., concentric phase, eccentric phase).

expected symmetry or asymmetry of left and right sides expected amount of time at a certain cable position expected repetition behavior (e.g., expected range of motion, expected time of completion of a repetition, expected amount of force applied by the user, etc.)

expected repetition at which spotting is activated (to assist user if they are struggling, for example). For example, spotting may be a precursor before flagging slow motion of the user as anomalous behavior (so that a condition is not flagged when it turns out that the user can be assisted by spotting them, reducing the resistance provided by the motor(s)).

expected duration between repetitions expected path of actuator (e.g., in 3D space over time, as determined, for example, by Bluetooth BLE 5.1 Angle of Arrival (AoA) information and Angle of Departure (AoD) information, or IMUs)

Expected lack or presence of motion of parts of the body not actively engaged with the actuator or resistance (e.g., as sensed via cameras). For example, frequent and significant leg or core motion during Bench Press may be indicative of an undesirable situation.

expected heart rate and/or change in heart rate expected respiratory rate and/or change in respiratory rate expected change in color of skin expected change in temperature of different body parts, as sensed by thermal imaging camera expected sounds produced by the user and the exercise machine, including grunts, hard breathing, and malfunctioning equipment For different exercises, different combinations of the aforementioned parameters may be used to determine a baseline pattern of usage of the exercise machine. In some embodiments, baseline patterns of expected usage of the exercise machine are determined by modeling engine 228 using information collected from client trainers such as exercise machine 202. The models may then be provided to the exercise machine for use in detecting deviations from expected behavior. Portions of the expected behavior may also be determined at the exercise machine.

In some embodiments, when a user is performing an exercise, streams of sensor measurements are used to determine current or observed values for the above pattern/model components to determine an observed pattern of usage of the exercise machine, which is then compared against the expected baseline usage pattern to monitor for deviations from the baseline that are above a threshold deviation (in which case it is determined that a condition has been detected).

In some embodiments, an unexpected event is detected when a change in the pattern of usage of the exercise device is detected. For example, if the observed pattern of usage of the trainer deviates from the baseline usage pattern by a threshold amount, then it is determined that unpredicted user behavior has occurred, which may be indicative of the potential occurrence of an emergency event. In this way, a degradation in performance may be detected. For example, statistics for each factor or component included in a pattern are determined and used to generate an envelope or bound on the pattern, where if the observed pattern deviates from one or more components of the expected pattern by a certain amount, with respect to any of the factors, then it is determined that a condition has been detected. For example, the detection envelope/threshold may be set as being two standard deviations away from the baseline value for the factor—that is, if the observed value of any of the factors in the pattern exceeds two standard deviations of the baseline value for the factor, then a condition is detected.

In some embodiments, the expected baseline pattern of usage is personalized. The bounds of the detection envelope for detecting conditions may also change based on personalized user history. For example, for a particular user, a model or parameterization of their performance may be generated to determine when spotting is activated, so that for that user, their usage behavior being different from another user is not necessarily indicative of that user being in an emergency condition.

In some embodiments, the expected or baseline pattern of behavior starts from a generalized understanding of how exercises are performed, with the values for signals of the generalized population falling within the detection envelope. The expected values of signals, as well as the detection envelope (e.g., deviation thresholds for various factors) may then be tuned over time for particular users, as historical workout performance information is collected as they use the device more and more.

As described above, the characterization of the baseline usage pattern of the trainer may be characterized based on an evaluation of a multitude of factors, example parameters of which are listed above. As one example, suppose that for a certain exercise, the baseline pattern of behavior is determined according to several axes: the amount of spotting or assistance needed, power, reps, weight, etc. If the observed pattern of usage of any of those factors varies by two standard deviations (or any other appropriate threshold to indicate that the user is currently out of the range of their baseline behavior), then it is determined that an unexpected change in behavior has occurred.

In some embodiments, an emergency condition is detected based on determination of an observed usage pattern deviating by a threshold from a baseline usage pattern (e.g., where one or more observed component values exceed their baseline component values by a threshold). In such cases, the trainer may not be aware of the underlying cause of the change in behavior or may not have definitive knowledge of the reason behind the user's change in behavior, but flags that the user's behavior is beyond the envelope of what is expected, and that therefore anomalous behavior in the usage of the trainer has been detected. Determining baseline usage patterns and monitoring for deviations from the baselines allows the condition and event detection to be performed without requiring specification of a particular condition to be monitored for. In this way, any unintended or unpredicted or unknown pattern of usage of the trainer may be detected.

The following are embodiments of determining baseline usage patterns of the exercise machine, as well as performance envelopes (e.g., attribute/model component deviation thresholds). As one example, an expected performance of a repetition of an exercise is determined. Deviations (beyond a threshold) from the expected repetition performance are flagged as condition events. The expected usage pattern for a repetition may be determined based on a variety of patterns such as an expected range of motion that the user is expected to be lifting at, a distance the cable is expected to be from the trainer, the expected speeds involved in performance of the repetition (e.g., for various phases of the repetition, such as for the concentric phase and/or the eccentric phase), the expected duration between repetitions, the expected amount of asymmetry (e.g., for two-sided moves, such as bench presses), etc.

As another example, a typical or expected path for an actuator, when used by a user, may be determined by estimating motion of the user using accelerometers, gyroscopes, etc. in IMUs in a smart handle or bar accessory/actuator. The IMUs may be used to estimate the 3-D location of the actuator over time as the user performs exercise. In some embodiments, the typical or expected path of the actuator in space over time is determined using historical IMU measurements. For example, expected trajectories of a handle when a user performs the exercise repetition are determined.

As another example, a camera coupled to the exercise trainer is used to monitor the form or pose of the user. In some embodiments, pose data captured using the camera is processed using a classifier that determines what move the user is performing, as well as the user's expected pose over the course of performing a repetition (or set of repetitions) of the move. The user's currently observed form may be compared against the expected form (based on sensor measurements from the camera) to determine whether the user is performing the move properly, or identifying whether the user is performing the incorrect exercise movement. As another example, a camera is used to identify and track movement of joints during performance of an exercise. In some embodiments, the trainer and/or backend uses the joint information to estimate the baseline amount of joint movement over time.

Deviations in one or more of these parameters or components that make up the expected pattern of behavior are monitored for and, if such deviations occur, then detection of such deviations is flagged as the detection of a condition event where alerts may be generated in response to anomalous behavior that deviates from the baseline usage behavior by more than a threshold.

Determination of the expected user repetition behavior may be performed in a variety of ways. For example, machine learning may be used with labeled training data (e.g., combinations of signals/parameters that are labeled as being within the expected pattern of usage, or outside of the expected pattern of usage). As another example, rules with designated thresholds may be used to determine when to trigger sending of alerts.

In some embodiments, expected user exertion/expressions of exertion are used as a factor in determining the expected baseline user behavior when performing exercise. In various embodiments, expected user exertions/expressions of exertion are determined using sensor measurements collected from sensors such as cameras and/or microphones (audio/video inputs), smart accessories such as heart rate monitors, etc. Such exertion determination may augment exertion measured from other sensors (e.g., cable-related measurements described above). In some embodiments, an expected or typical or baseline exertion of the user when performing an exercise repetition is estimated using sensor measurements from cameras and/or microphones. For example, redness of a user's face may be indicative of their level of exertion. The baseline coloring of a user's face is determined from camera sensor measurements captured during performance of an exercise movement. Deviation from the baseline coloring (e.g., where redness exceeds a threshold deviation) causes triggering of a condition/event. An expected frequency/volume of sound (e.g., from grunting or groaning or respiration or other signs of exertion) may also be determined from microphone inputs. In some embodiments, deviation from the baseline level of sound exertion (e.g., where sound exertion exceeds a threshold deviation) causes triggering of a condition/event.

When determining a baseline pattern of usage of the exercise machine, the various sensor measurements, which may come from various parts of the trainer, are fused together using sensor fusion, as described above. For example, the determination of the path of the handles may be fused with data from other measurement sources, such as cameras, microphones, etc. in order to determine the current observed usage behavior.

The following are embodiments of determining an expected pattern of usage of an exercise machine when performing an exercise. In some embodiments, the expected pattern of usage is determined using modeling engine 228. When a user performs an exercise movement during normal usage, the corresponding stream of sensor measurements (that correspond to when the user is performing the exercise) is observed and collected and aggregated. Such sensor measurements may be collected or aggregated across multiple repetitions of the exercise movement. In some embodiments, each different type of exercise movement is associated with its own corresponding set of sensor measurements (e.g., the sensor measurements observed during normal performance of the bench press are associated with each other, the sensor measurements observed during normal performance of the bicep curl are associated with each other, etc.—that is, sensor measurements may be grouped by exercise type).

The average (or any other type of aggregation, as appropriate) of the observed sensors measurements is established as a baseline. Various statistics pertaining to the sensor measurements are determined, such as variance over time. The amount of deviation for triggering a condition alert may be set as, for example, double the normal variance before it is determined that unexpected behavior has occurred. This variance threshold may be constant across users, or may be personalized. As one example, different people may have different baseline redness (as a measure of exertion), but the same delta or threshold amount of variance in redness is used for all people to indicate a dangerous amount of exertion (and trigger a condition alert).

In another embodiment, the boundaries of normal usage versus dangerous or unnatural usage are estimated or otherwise determined based on heuristics.

The rules for triggering alerts may be tuned at various levels. For example, some rules cover a population of users (e.g., range of motion, velocity, etc.—where, for example, there may be a physical limit on how quickly users can move, and these rules may be generic based on human form and how fast users are able to move, based on the weight they are resisting, etc.), while some rules are personalized (e.g., some measures, such as grunts and groans while working out, how red or flush a user becomes when working out, etc. may vary widely amongst a population of users). Thus, the behavior model or pattern may include generalized components that are applicable to all users (e.g., generalized population), as well as personalized components that are specific to a particular user.

Using the techniques described above, a baseline behavior pattern of the user when performing exercise is established. When deviations from the baseline established for the user are detected, responsive actions are taken accordingly.

In some embodiments, the exercise machine is configured to detect or monitor for specific types of known events. The known events may be characterized according to a set of sensor parameters. These known events may be stored to the exercise machine for monitoring.

One example of a type of event that is monitored for is the sudden dropping of a handle. As one example, changes in cable length and signals from the accelerometers may be used to determine that a user has suddenly dropped or released one of the handles. This is an example of detection of an abrupt change in usage pattern of the device. As one example, the trainer includes a model that indicates a baseline speed of retraction in cable length for a workout (where this baseline speed may differ between movements). If the speed of retraction in cable length is observed to be more than two standard deviations above the baseline, then the trainer determines that an unexpected event occurred, which, in this case, may be indicative of sudden release of an actuator.

The following are additional embodiments of detecting cable dropping, which may be based on characterization or parameterization of various types of signals. If the handle is suddenly released, the cable will suddenly retract back into the arm of the trainer, due to the torque of the motor which had been providing resistance to the user (who has now let go, such that there is no user force opposing the motor, where the motor will retract the cable, unopposed). In some embodiments, sudden acceleration of the cable (e.g., magnitude of cable acceleration being greater than a threshold acceleration) is used to trigger detection of cable dropping. The speed of the cable exceeding a threshold cable speed is also a signal used to indicate cable dropping. As another example, in some embodiments, the handle is connected to a cable via a ball stop that includes a connector for connecting the handle to the cable (as well as to connect other types of actuators, such as bars). In some embodiments, the ball stop includes a pressure sensor. If the force measured on the ball stop exceeds a threshold force (e.g., because the ball stop has hit an arm of the trainer harder than expected), then dropping of the cable is determined to have been detected. As another example, deceleration of the cable when the cable is near ground (and is almost hitting the ball stop) is used to determine whether an actuator has been suddenly dropped. In this example, the cable position, as well as change in speed of the cable is monitored. If there is deceleration that exceeds a threshold when the actuator is near ground (and the cable is nearly retracted), then this may indicate that the cable was not gently put down by the user—rather, the cable was suddenly released, which results in sudden deceleration when the actuator reaches ground.

Another example of a type of event that is monitored for by the exercise machine is the user being pinned down. For example, if the user is using a bar attachment/actuator to perform a bench press exercise, the condition detection engine is configured to monitor for the user being pinned by the bar. For example, for the bench press, the trainer is configured with a baseline value of the speed of cable extraction/retraction when the user (or typical user) performs the bench press. If the speed during the period that the user should be performing the bench press is two standard deviations away from the baseline (or the cable is only changing by small amounts for a prolonged amount of time), then it is determined that an unusual pattern of usage of the trainer has been detected. As this may be indicative of the user being pinned down by the bar, or perhaps entangled in the cable, this change in usage pattern of the trainer is flagged as the potential occurrence of an emergency condition.

Another example of a type of event that is monitored for is the occurrence of a heart attack, which in some embodiments is based on heart rate measurements from a heart rate monitor accessory that is coupled with the exercise machine (e.g., heart rate sensor embedded in an actuator, heart rate sensor in a smart watch that communicates with the exercise machine, etc.). Another example of a type of event that is monitored for is stroke, which may also be monitored for by analyzing the stream of measurements from a heart rate monitor.

In some embodiments, when an unexpected event occurs, contextual information is determined (if available) pertaining to a context in which the detected event occurred. This may be used to determine an estimation of an emergency condition (and whether, for example, the unexpected event is indicative of an emergency condition). The context may include other observed usage patterns of behavior that deviate from baseline usage patterns. That is, if multiple different types of unexpected behavior patterns are determined to have occurred overlapping in time, then the confluence of multiple unexpected behaviors is used to estimate the occurrence of an emergency event.

For example, suppose that the user's exertion and heart rate are determined to exceed a baseline exertion/heart rate by a threshold amount. Suppose also that it is determined that the user has dropped the handle, another example of an unexpected event that has been detected. The context of when this deviation in behavior occurred is determined. For example, historical context is obtained, such as the user's one rep maximum, the maximum number of reps for any one workout at a projected weight. This provides a baseline known behavior for the exercise. Suppose that the user has increased the weight and is setting personal records. This results in the trainer determining a deviation in workout behavior for the user relative to their previous historical baseline. This indicates that they are exerting themselves. In combination with the drop in the handle, as well as heart rate peaking, a more accurate estimation of the likelihood of the occurrence of an emergency condition is determined. For example, in this case, the user has dropped the handle while their heart rate is elevated compared to a baseline value, which has occurred while the workout is being performed at a higher intensity level with more than typical weight, which in aggregate results in a higher likelihood estimate that an emergency condition has occurred. In this way, multiple types of behavior patterns, may be evaluated when estimating an emergency condition.

Event Handling

As described above, in some embodiments, alerting engine (232) is configured to respond to the detection of the event. As will be described in further detail below, in various embodiments, such actions include those determined locally at the trainer, as well as those determined and taken by remote entity such as backend 206. That is, the alerting and taking of responsive action may be distributed across the local client, as well as the remote backend. Various embodiments of event detection are described below.

In some embodiments, in response to detecting a (potential) emergency condition, the trainer automatically reduces the resistance provided by the motor.

Escalation Path

In some embodiments, depending on the type of unexpected behavior that has been detected, prior to generating alert messages to emergency contacts or performing other types of alerting, the trainer confirms whether an emergency event has occurred. As one example, suppose that the machine has detected that at least one of the handles was dropped. In some embodiments, the trainer is configured to provide as output (e.g., via the display and/or speakers) a message prompting the user to confirm that they are "ok" within a threshold amount of time (e.g., via a voice input confirming their wellness, or another type of input, such as pressing on a button rendered on the screen). In some embodiments, if confirmation is not received (e.g., within a threshold amount of time), the trainer then escalates to a next stage of event handling by sending a communication to a designated emergency contact. As another example, additional sensors (such as cameras and microphones) are activated to obtain additional sensor data to further evaluate the likelihood of an emergency condition. For example, additional deviations from baseline patterns determined using a stream of measurements from the additionally activated sensors may be determined. In this way, as the trainer may ultimately be unable to know the reason behind an observed change in usage pattern, by detecting deviations from a baseline, the trainer may then follow an escalation path for learning and more confidently understanding the condition of the user, and then take the appropriate set of actions.

If, on the other hand, the user provides feedback indicating that the detected anomalous behavior is not an emergency condition, then the expected model of the user when performing the exercise can be updated to adjust the detection envelope such that the deviation thresholds are modified to include the observed pattern of behavior as being within bounds (and not a cause for triggering detection of an emergency condition). In this way, the next time the trainer observes a similar pattern (e.g., set of sensor measurements with similar velocity, cable length, etc.), the pattern is filtered out, and does not trigger detection of the potential occurrence of an emergency condition.

Sensor Escalation

As described above, in some embodiments, in response to detection of an event, the alerting engine is configured to escalate the use of additional sensors. The escalation of what sensors to activate may be determined according to an escalation path, such as that described above. For example, given permission by the user, in certain states (such as when unexpected patterns of usage of the trainer have been detected), the trainer activates an additional sensor such as a camera in order to allow viewing of the user. The video feed from the activated camera may then be used as another stream of sensor information that can augment the sensor measurements that have already been taken to detect the initial event to determine whether an emergency has occurred. In this way, privacy is preserved unless a potential emergency situation has occurred (and the user has provided consent for the camera, for example, during an earlier trainer setup or configuration phase).

Thus, in some embodiments, an escalating number of sensors is activated to detect emergency events. The additional sensors may be used to provide further streams of sensor information to augment an initial set of sensors (e.g., from encoders to determine cable velocity, cable length, etc.). In this way, multiple layers of investigation are progressively facilitated depending on what events have been detected.

In some embodiments, the trainer and/or backend asks the user for permission to allow the utilization of additional sensors (e.g., microphone and/or camera) in case of emergency. The user may opt into the use of some sensors and not others depending on various rules, such as allowing the camera, but not the microphone. In this way, the user is asked for permission as to whether additional sensor data may be obtained for evaluation in case of the potential occurrence of an emergency situation being detected. This permission may be requested as a pre-approval, such as during set up or configuration of the trainer (e.g., by directly providing permission through the trainer, via a companion smartphone application, etc.). In some embodiments, when a sensor such as a camera or microphone is activated during detection of a potential emergency condition, an indicator (e.g., status light) is turned on that indicates that a sensor has been turned on and is being utilized.

Emergency Contacts

In some embodiments, in response to detection of an emergency condition, the backend is configured to transmit messages or alerts, or otherwise communicate, to one or more contacts. In various embodiments, such contacts include emergency services, designated contacts set by the user, etc.

The alerting of an emergency contact may be performed through various mechanisms. For example, in response to an emergency event, the trainer signals the backend, which in various embodiments, initiates automated calls, sends push notifications, generates and transmits text messages, etc. The trainer may also be configured to perform such contacting.

In some embodiments, a human-in-the-loop confirmation is facilitated, where the backend (and/or trainer) attempts to communicate to the user, requesting them to respond to a prompt, such as whether the detected event is a false alarm, or whether the user acknowledges that it is an emergency, etc. For example, the camera and speaker and microphone of the trainer may be activated (e.g., as part of the escalation path) to transform the trainer into a "speaker phone" in which an operator, as part of a monitored service, is able to directly contact the user. In some embodiments, if a user is non-responsive (or the trainer/backend is unable to detect a response) within a threshold amount of time, emergency services and/or designated contacts are automatically contacted. In some embodiments, in such a monitored service, in addition to communicating with the user performing the exercise, an operator may call other emergency contacts/services on the user's behalf, where the operator also closes the loop with an emergency contact.

Trainer as Siren

As another example of an action that is taken in response to detection of an emergency condition, the trainer is programmed to act as a siren. For example, the speakers may be controlled to output an alert or siren signal to alert any other people who may be in audible range of the exercise trainer. The trainer may also provide a visual indication of an emergency condition, for example, by flashing or strobing red colors on the display of the trainer (e.g., in order to visually attract the attention of users).

Remote Control of Trainer

In some embodiments, a human operator (e.g., via the monitored service provided by the backend that communicates with trainers) is provided remote control of the device when they are in the loop. The human operator may then control various aspects of the trainer, such as turning off resistance (e.g., turning off the motor). The human operator may also perform other actions, such as turning on the camera to view the user (subject, for example, to pre-approval), turning on a microphone, turning on speakers, turning off the weight, turning the trainer into a siren, flashing or pulsing red light, etc. In some embodiments, the human operator is provided a remote dashboard to control the client trainer.

As another example, a contact designated by the user may be assigned as a person that can view the camera feed of the trainer when the user is determined to be in potential duress (e.g., in a potential emergency condition). In this case, when an emergency event is triggered, the contact is notified and given access to the camera feed of the trainer. The user may also be given access to the microphone so that they can communicate via the trainer. In this way, a contact may be able to investigate and provide assistance (while emergency services may also be contacted simultaneously or in parallel). In this way, a distributed monitoring capability that involves various contacts and emergency services is facilitated.

Customer Service Interaction Transition

As described above, the event handler is configured to detect anomalous usage of the trainer (e.g., behavior that deviates by a threshold amount from expected or baseline usage of the trainer). The anomalous usage may not always be due to an emergency occurring from a health and safety perspective. For example, it may be the case that there is an issue with the trainer itself. In this case, the user may indicate that there is an error. For example, the user may indicate that they are fine, but that there appears to be an issue with the trainer. This user input may then be used as feedback to determine whether a mis-detection has occurred and that the user is not in an emergency situation, but rather that there may be an issue with the trainer, such as there being an issue with the motor, or an issue with retraction of the cable. In this way, the condition detection may loop into a customer service interaction if appropriate. For example, a service ticket may be automatically generated to indicate that anomalous trainer behavior has been detected, and that a diagnostic or health check should be performed on the trainer to determine if there are any faults with the trainer.

The various actions described above that are performed in response to detection of a potential emergency condition may be governed according to a set of policies. For example, policies may be configured that dictate when certain actions are taken, such as when the activation of certain additional sensors (e.g., cameras, microphones, etc.) occurs (e.g., so as not to unnecessarily intrude on a user's privacy unless there is an emergency condition), or the conditions under which an action is taken, such as that an action is taken only when a certain set of conditions occurs, or that a certain contact is notified based on a certain set of conditions, etc. For example, a user may specify a policy where a certain designated contact is always contacted in response to any detection of a condition. Policies may also define when certain alerting mechanisms are used based on the severity/consequences of the alerting mechanism. The conditions for determining whether to trigger different alerts or actions may be based on heuristics, user settings, thresholds, rules, learned behaviors, etc.

Figure 3:
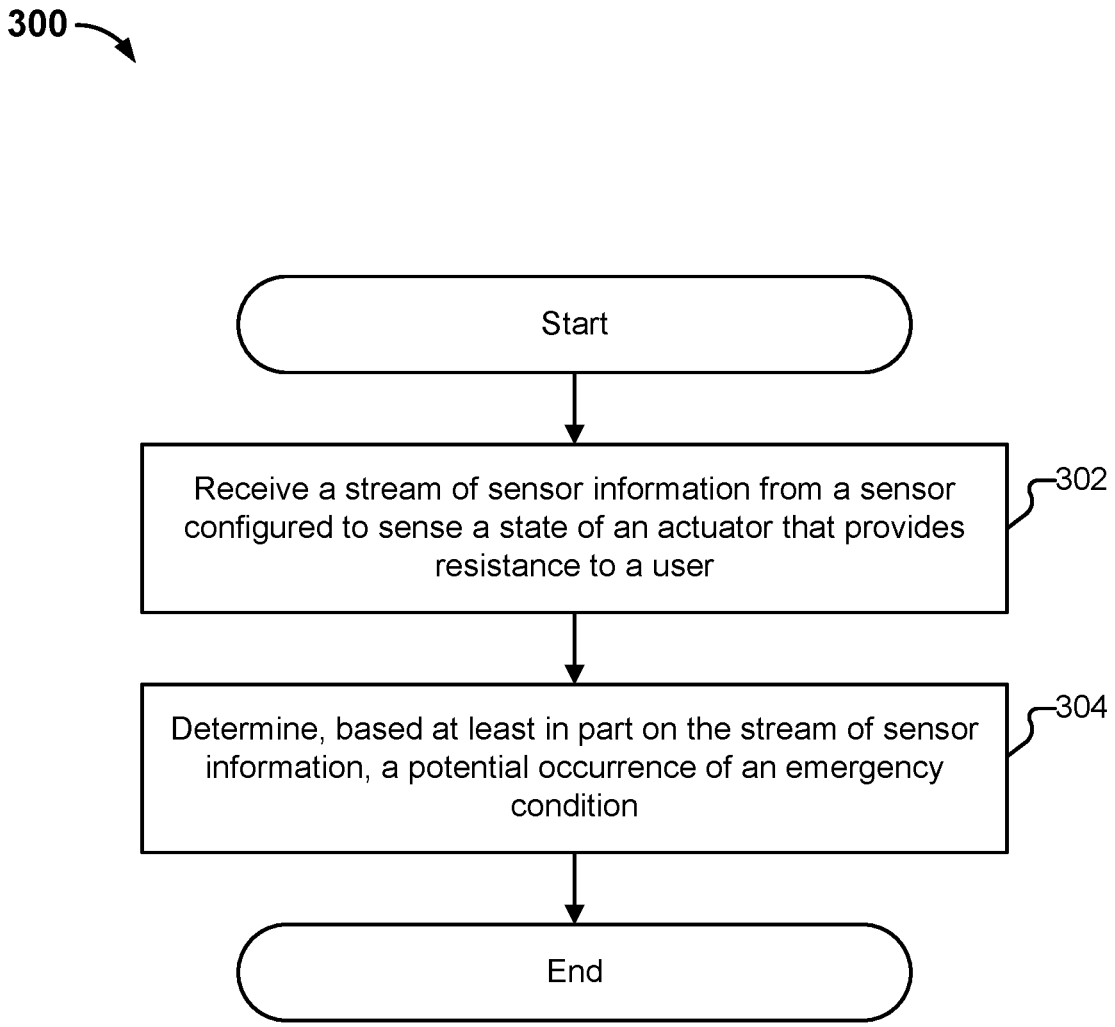
FIG. 3 is a flow diagram illustrating an embodiment of a process for condition detection.

FIG. 3 is a flow diagram illustrating an embodiment of a process for condition detection. In some embodiments, process 300 is executed by an exercise device such as exercise machine 202. At 302, a stream of sensor information is received from a sensor that is configured to sense a state of an actuator that provides resistance to a user.

Embodiments of digital strength trainers usable to provide resistance to a user when performing exercise are described above. Various examples and embodiments of sensors of an exercise machine and sensor measurements are also described above.

At 304, based at least in part on the stream of sensor information, a potential occurrence of an emergency condition is determined. For example, the sensed state of the actuator (e.g., actuator path, cable measurements such as velocity, range of motion, etc. as described above) is analyzed to determine the potential occurrence of an emergency condition. For example, the stream of sensor information is compared against baseline usage patterns to determine deviations from the baseline. Detected deviations that exceed a threshold are identified as a potential occurrence of an emergency condition. Multiple input factors (from a variety of sensors) may be used to make the determination of the potential occurrence of an emergency condition. Further examples and embodiments of determining baseline behavior patterns and detecting deviations from such baseline patterns are described above. Various actions may be performed in response to detection of the potential occurrence of an emergency condition, examples of which are described above.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise device, comprising:

an actuator configured to provide resistance to a user;

a plurality of sensors configured to sense a state of the actuator over time, wherein the plurality of sensors includes two or more of the following: a sensor to measure position of the actuator, a sensor to measure position of a motor, a sensor to measure voltage and/or current being consumed by the motor, a sensor to measure how much force is being applied to the actuator by the user, or a sensor used to measure an acceleration and a rate of rotation of the actuator; and an emergency event handler configured to:

receive a stream of information from the plurality of sensors; and determine, based at least in part on the stream of information, a potential occurrence of an emergency condition, comprising to:

determine a baseline usage pattern of the exercise device based on the stream of information, wherein the baseline usage pattern comprises one or more of the following: an average of observed ranges of motion, an average of observed times between repetitions, an average of observed number of times that the user is spotted, an average of observed cable velocity, or an average of observed asymmetry between first and second cables of the exercise device, wherein the baseline usage pattern is determined using a model, wherein the model implements a machine learning technique, and wherein the model is trained using labeled training data, and wherein the baseline usage pattern is determined for an exercise based on historical workout data associated with the user;

compare an observed pattern of usage of the exercise device with the baseline usage pattern to obtain a deviation, comprising to:

receive first sensor information from a first sensor of the plurality of the sensors and second sensor information from a second sensor of the plurality of the sensors;

combine the first sensor information and the second sensor information to obtain the observed pattern of usage, wherein the combining includes to aggregate the first sensor information and the second sensor information to obtain the observed pattern of usage;

determine the baseline usage pattern based on a first exercise or a second exercise; and compare the observed pattern of usage with the baseline usage pattern to obtain the deviation; and in response to a determination that the deviation is equal to or greater than a variation threshold:

activate a third sensor to obtain third sensor information, wherein the third sensor includes one or more of the following: a camera or a microphone;

evaluate a likelihood of the emergency condition has occurred based on the third sensor information; and in the event that the likelihood of the emergency condition is below an emergency threshold, adjust the variation threshold.

2. A method, comprising:

receiving a stream of sensor information from a plurality of sensors configured to sense a state of an actuator configured to provide resistance to a user, wherein the actuator is associated with an exercise device, wherein the plurality of sensors includes two or more of the following: a sensor to measure position of the actuator, a sensor to measure position of a motor, a sensor to measure voltage and/or current being consumed by the motor, a sensor to measure how much force is being applied to the actuator by the user, or a sensor used to measure an acceleration and a rate of rotation of the actuator; and based at least in part on the stream of sensor information, determining a potential occurrence of an emergency condition, comprising:

determining a baseline usage pattern of the exercise device based on the stream of information, wherein the baseline usage pattern comprises one or more of the following: an average of observed ranges of motion, an average of observed times between repetitions, an average of observed number of times that the user is spotted, an average of observed cable velocity, or an average of observed asymmetry between first and second cables of the exercise device, wherein the baseline usage pattern is determined using a model, wherein the model implements a machine learning technique, and wherein the model is trained using labeled training data, and wherein the baseline usage pattern is determined for an exercise based on historical workout data associated with the user;

comparing an observed pattern of usage of the exercise device with the baseline usage pattern to obtain a deviation, comprising:

receiving first sensor information from a first sensor of the plurality of the sensors and second sensor information from a second sensor of the plurality of the sensors;

combining the first sensor information and the second sensor information to obtain the observed pattern of usage, wherein the combining includes aggregating the first sensor information and the second sensor information to obtain the observed pattern of usage;

determining the baseline usage pattern based on a first exercise or a second exercise; and comparing the observed pattern of usage with the baseline usage pattern to obtain the deviation; and in response to a determination that the deviation is equal to or greater than a variation threshold:

activating a third sensor to obtain third sensor information, wherein the third sensor includes one or more of the following: a camera or a microphone;

evaluating a likelihood of the emergency condition has occurred based on the third sensor information; and in the event that the likelihood of the emergency condition is below an emergency threshold, adjusting the variation threshold.

3. A computer program product embodied in a non-transitory computer readable storage medium and comprising computer instructions for:

receiving a stream of sensor information from a plurality of sensors configured to sense a state of an actuator configured to provide resistance to a user, wherein the actuator is associated with an exercise device, wherein the plurality of sensors includes two or more of the following: a sensor to measure position of the actuator, a sensor to measure position of a motor, a sensor to measure voltage and/or current being consumed by the motor, a sensor to measure how much force is being applied to the actuator by the user, or a sensor used to measure an acceleration and a rate of rotation of the actuator; and based at least in part on the stream of sensor information, determining a potential occurrence of an emergency condition, comprising:

determining a baseline usage pattern of the exercise device based on the stream of information, wherein the baseline usage pattern comprises one or more of the following: an average of observed ranges of motion, an average of observed times between repetitions, an average of observed number of times that the user is spotted, an average of observed cable velocity, or an average of observed asymmetry between first and second cables of the exercise device, wherein the baseline usage pattern is determined using a model, wherein the model implements a machine learning technique, and wherein the model is trained using labeled training data, and wherein the baseline usage pattern is determined for an exercise based on historical workout data associated with the user;

comparing an observed pattern of usage of the exercise device with the baseline usage pattern to obtain a deviation, comprising:

receiving first sensor information from a first sensor of the plurality of the sensors and second sensor information from a second sensor of the plurality of the sensors;

combining the first sensor information and the second sensor information to obtain the observed pattern of usage, wherein the combining includes aggregating the first sensor information and the second sensor information to obtain the observed pattern of usage;

determining the baseline usage pattern based on a first exercise or a second exercise; and comparing the observed pattern of usage with the baseline usage pattern to obtain the deviation; and in response to a determination that the deviation is equal to or greater than a variation threshold:

activating a third sensor to obtain third sensor information, wherein the third sensor includes one or more of the following: a camera or a microphone;

evaluating a likelihood of the emergency condition has occurred based on the third sensor information; and in the event that the likelihood of the emergency condition is below an emergency threshold, adjusting the variation threshold.

* * * * *